US009628895B2

(12) United States Patent
Malaviya

(10) Patent No.: US 9,628,895 B2
(45) Date of Patent: Apr. 18, 2017

(54) ANIMAL HEADPHONE APPARATUS

(71) Applicant: Lalkrushna Malaviya, Philadelphia, PA (US)

(72) Inventor: Lalkrushna Malaviya, Philadelphia, PA (US)

( * ) Notice: Subject to any disclaimer, the term of this patent is extended or adjusted under 35 U.S.C. 154(b) by 321 days.

(21) Appl. No.: 14/195,577

(22) Filed: Mar. 3, 2014

(65) Prior Publication Data

US 2014/0247951 A1 Sep. 4, 2014

Related U.S. Application Data

(60) Provisional application No. 61/771,510, filed on Mar. 1, 2013.

(51) Int. Cl.
*H04R 1/10* (2006.01)

(52) U.S. Cl.
CPC ..... *H04R 1/105* (2013.01); *H04R 1/1041* (2013.01); *H04R 2460/07* (2013.01)

(58) Field of Classification Search
CPC . H04R 1/105; H04R 1/10; H04R 5/02; H04R 1/1016; H04R 1/403; H04R 5/023; H04R 1/1041; H04R 2460/07; G06F 3/048; H04N 5/2353
USPC ... 381/309, 72, 322, 74, 328, 380, 382, 151, 381/104, 388; 181/135, 130, 131, 134; 119/712, 715, 719; 715/841; 348/229.1
See application file for complete search history.

(56) References Cited

U.S. PATENT DOCUMENTS 8,333,260 B1 * 12/2012 Hall ..... H04R 1/1016 181/130
2003/0006346 A1 * 1/2003 Wolf ..... A63H 19/14 246/187 A
2003/0059071 A1 * 3/2003 Dunham ..... H04R 1/1016 381/309
2005/0063555 A1 * 3/2005 Berardi ..... H04R 1/403 381/104
2013/0007668 A1 * 1/2013 Liu ..... G06F 3/012 715/841
2013/0022220 A1 * 1/2013 Dong ..... H04R 5/023 381/151
2014/0168468 A1 * 6/2014 Levoy ..... H04N 5/2353 348/229.1

OTHER PUBLICATIONS

Plantronics, Plantronics Backbeat 903/906 User Guide, 2009, All.*
(Continued)

*Primary Examiner* — Vivian Chin
*Assistant Examiner* — Ubachukwu Odunukwe

(57) ABSTRACT

An animal headphone apparatus is a modified headphone device specifically suited for use with dogs, so that an owner may allow their dog or other pet to listen to music, or the owner may use the headphones to command, train or monitor their pet. A first earpiece and a second earpiece are oriented inward and downward to account for the substantially vertical structure of a canine ear canal. A chipset and a power source provide capability for several features, including an integrated music player, at least one camera, a microphone, a vibration producing device, a global positioning system device, and at least one digital display for video viewing by the dog or other pet. A wireless communication device allows a user to control the various features through a smart phone or remote control.

11 Claims, 13 Drawing Sheets

(56) References Cited

OTHER PUBLICATIONS

Plantronics, http://www.plantronics.com/images/catalog/product/large/backbeat903.png, Feb. 16, 2016.*

* cited by examiner

ANIMAL HEADPHONE APPARATUS

The current application claims a priority to the U.S. Provisional Patent application Ser. No. 61/771,510 filed on Mar. 1, 2013. The current application is filed on Mar. 3, 2014 while Mar. 1, 2014 was on a weekend.

FIELD OF THE INVENTION

The present invention relates generally to audio equipment. More specifically, the present invention is a set of headphones primarily intended for use by dogs, although the present invention may be utilized with cats, horses, and other animals. The headphones feature a special design that is well suited for use within the anatomy of a dog's ears and other animals with similar ear anatomy.

BACKGROUND OF THE INVENTION

Domesticated animals have been shown to be responsive when presented with music. Music has been shown to soothe and calm agitated dogs while bringing them into a relaxed state. This is particularly useful in situations that dogs may find upsetting or exciting such as during thunderstorms and in unfamiliar areas or crowded locations such as parties and airports. Additionally, some dogs grow agitated and restless when left alone. As such, it is difficult to calm an agitated dog when an owner wishes for the dog to rest. Owners may play music for their dogs although this results in the owners having to listen to the same music as well. Dog ears are typically more sensitive than human ears making it difficult for owners to find an appropriate volume at which a dog may listen to music without causing pain. The present invention seeks to address the aforementioned issues and provide dogs with an effective and non-intrusive means of listening to music.

The present invention is a set of headphones that is specially designed for the unique interior anatomy of a dog's ears. Although the present invention is primarily intended for use by dogs, the present invention may be utilized by any animal or pet, within reason. In its preferred embodiment, the present invention comprises two speakers connected by a flexible band. Each speaker is oriented at an inward and downward angle. This is due to the unique interior structure of a dog's ear canal. A dog's ear canal immediately adjacent to the ear itself is approximately vertical. The vertical portion of the ear canal is connected to an approximately horizontal portion of the ear canal. The present invention accommodates the unique interior anatomy of a dog's ear canal as the speakers of the headphones are positioned in a manner such that audio is directed in an inward and downward direction. The headphones can be held in place by means of an adjustable chin strap. The speakers of the present invention emit audio that is optimized for dogs. More specifically, the maximum volume of the audio is much lower to protect sensitive dog ears. Additionally, the audio is emitted at a frequency that is pleasing to dogs. Extremely high and low notes that are displeasing to dogs are removed from music as well. Middle notes and tones that have been shown to be pleasing to dogs serve to soothe and relax the dogs. Alternatively, some headphones may emit higher frequency sound at higher volume. In combinations with one or more built-in microphones, it can be used as a hearing aid for animals. The headphones of the present invention are not limited with respect to specific design and/or material. Additionally, the present invention may incorporate various different designs to accommodate for other animals.

In the preferred embodiment of the present invention, the headphones are compatible for use with conventional music players or mobile phones. The headphones may communicate with music players via both wired and wireless connections including radio signals. Alternative embodiments of the present invention feature headphones with integrated and self-contained music players. Users may record their own songs or vocal recordings as desired. Additionally, users may listen to the same music as their dogs, but at a frequency and volume that is more standard for human listening. Users may control the headphone via a remote control or any mobile device. Alternatively the headphone may have cellular or Wi-Fi connectivity.

The present invention has numerous applications beyond providing a means for dogs to enjoy music. The present invention may be integrated with convention invisible fence systems designed to contain pets within a defined area. The speakers of the present invention may emit a displeasing audible noise, a prerecorded command by the dog's owner, a vibration or any combination of the above when a dog travels too close to a boundary to prevent the dog from crossing the boundary. Similarly, the displeasing audible noise, prerecorded command by the dog's owner or vibration may be utilized as an anti-barking deterrent. A Global Positioning System (GPS) component may be integrated into the headphones to allow owners to quickly locate a lost dog. Similarly, a camera may be integrated into the headphones to allow owners to monitor the area around their dogs so that the owner can record video or watch it in real time via wireless connectivity.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

Figure 1:
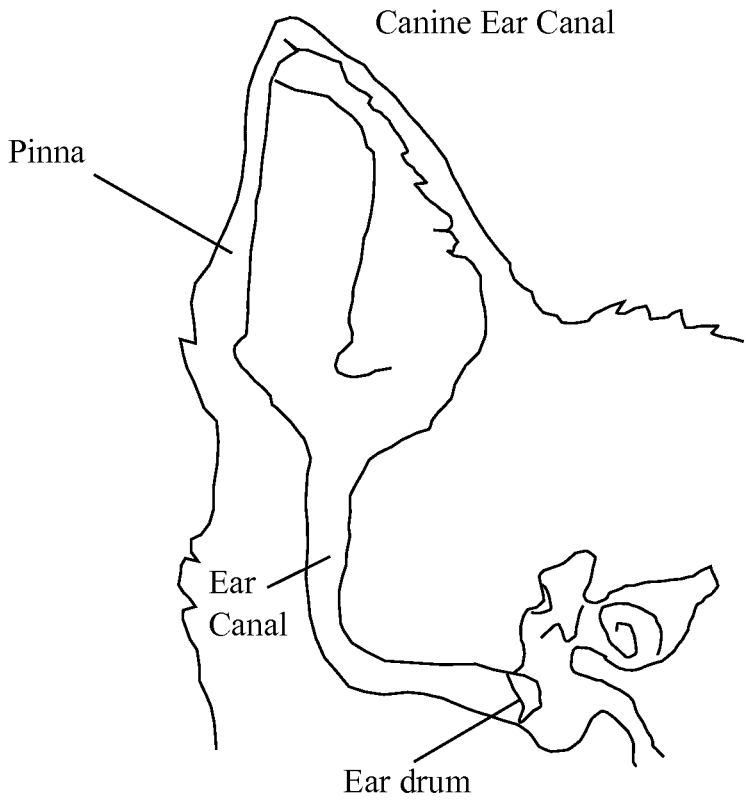
FIG. 1 is a diagram of the anatomy of a canine ear canal.

The present invention is a set of headphones that is specifically designed for use by animals, specifically dogs, with a physical structure that is adapted for the interior anatomy of a dog's ears, as seen in FIG. 1. Similar anatomy is also seen in many other animals. In the preferred embodiment, two speakers are connected by a band of material as is common for some headphones, but the present invention is primarily suited for the interior anatomy of a dog's ears by having the earpieces of the headphones being oriented in a desired orientation, which is substantially downward and inward in relation to a dog's head. The earpieces may have holes to direct the sound downward. In the preferred embodiment of the present invention, each of the earpieces has two lateral holes perpendicularly traversing from the interior of the earpiece outward oriented so that the sound waves are guided more directly into the ear canal. This desired orientation is in order to match the interior anatomy of a dog's ear which comprises a substantially vertical canal immediately inside the pinna, or visible portion of the ear that rests on the outside of the head.

The preferred embodiment of the present invention is capable of establishing a wired or wireless connection with a conventional music player or mobile phone. Standalone music players or mobile phones may be retained on a dog's collar during use. Additionally, users and their dogs may listen to the same music or audio recordings. Audio played through the dog's headphones is optimized for volume and frequency to provide a comfortable listening experience. Extremely high and low notes that are displeasing to dogs are removed from music. Middle notes and tones that are pleasing to dogs serve to soothe and relax the dogs. The present invention may incorporate noise cancellation technology that may be activated and deactivated as needed. Cables of wired configurations of the present invention are not limited with respect to design. For example, cables may be short to avoid entanglement or snagging. The cables may alternatively be looped onto hooks present on the headphones or the cables may be retractable for storage when the headphones are not in use, as well as for adjusting the length of the cable while in use. A smart device may be paired via a wired or wireless connection with the headphones in order for the smart device to function as a controller of the headphones.

Figure 2:
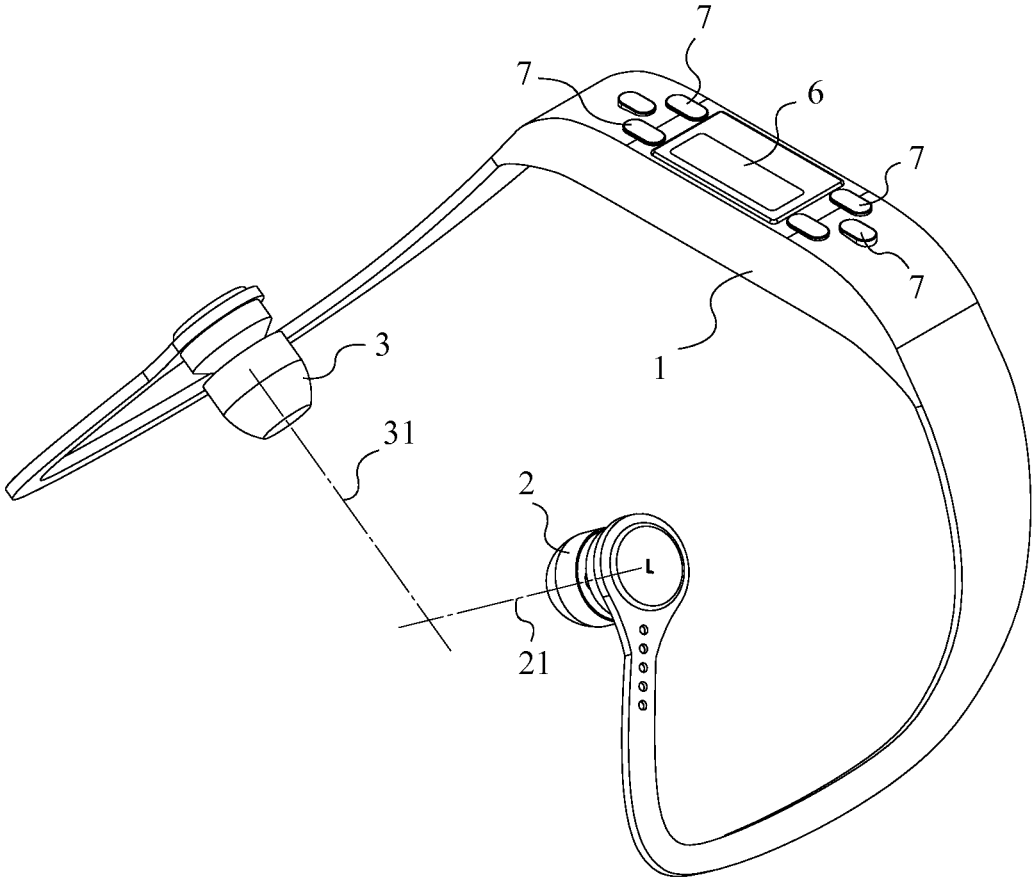
FIG. 2 is a perspective view of the present invention.
Figure 3:
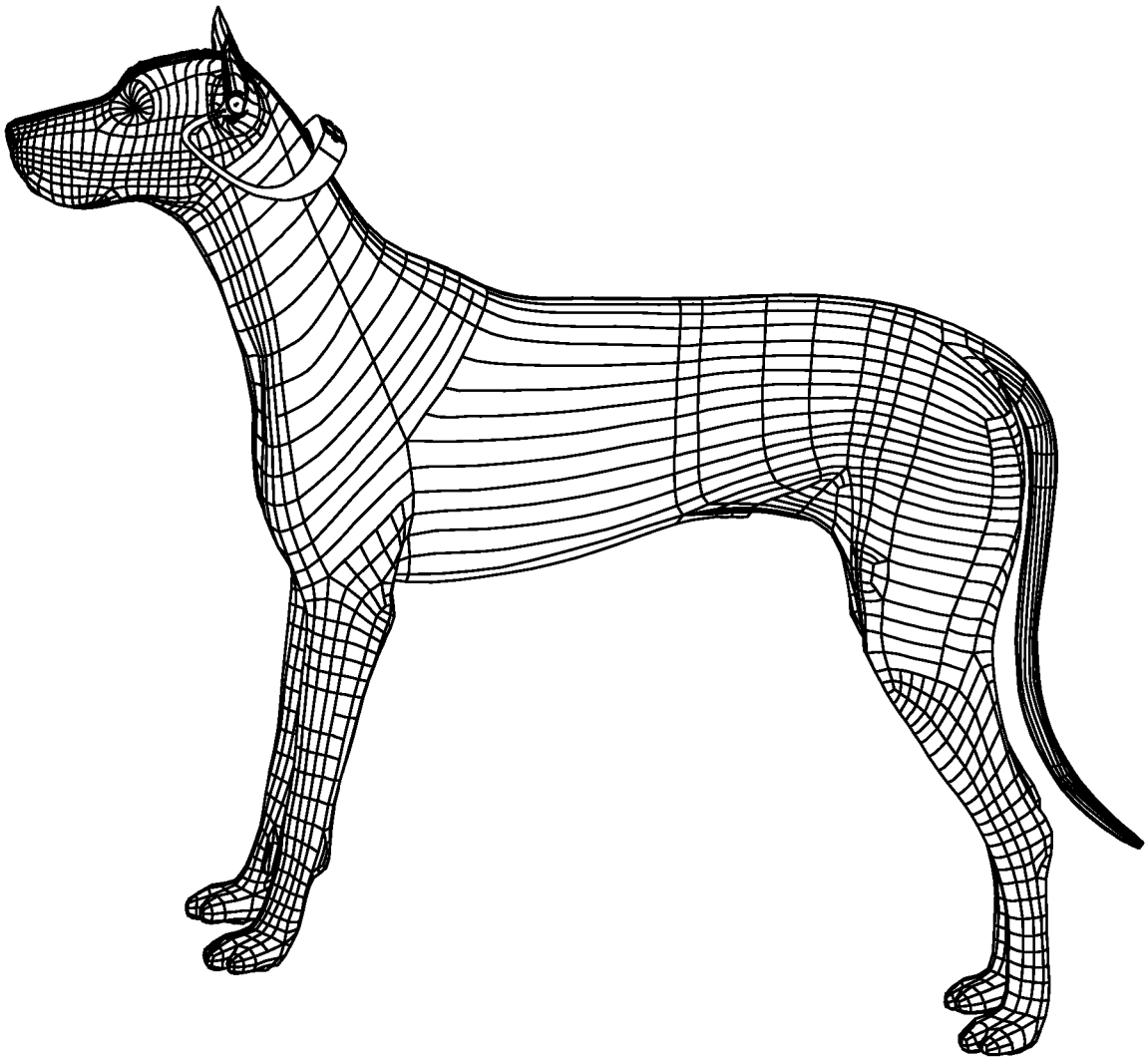
FIG. 3 is a left-side view of the present invention in use on a dog.

Referring to FIG. 2, the preferred embodiment of the present invention comprises a headband chassis 1, a first earpiece 2 with a first earpiece axis 21, and a second earpiece 3 with a second earpiece axis 31. Additionally, the preferred embodiment of the present invention comprises a chipset 4 and a power source 5, enabling the present invention to be a standalone unit that does not require a separate peripheral music player to play music through the present invention. In an alternate embodiment, however, the chipset 4 and power source 5 are not included, and the present invention functions solely as typical headphones with the desired orientation of the first earpiece 2 and second earpiece 3. In this embodiment, it is necessary for a separate audio player unit to be connected to the present invention via a cord. It should be noted that the headband chassis 1, the first earpiece 2 and the second earpiece 3 are not limited with respect to physical design or material, with the exception that the orientations of the first earpiece 2 and the second earpiece 3 match the interior anatomy of a dog's ears. In an alternate embodiment the present invention may incorporate a chin strap for holding the present invention in place on a dog's head. An additional strap may be incorporated to secure the present invention to a dog's collar in order to prevent the present invention from becoming lost or dislodged during movement. FIG. 3 shows the present invention in use on a dog.

The first earpiece 2 is connected to the headband chassis 1, and the second earpiece 3 is connected to the headband chassis 1 opposite the first earpiece 2. The first earpiece 2 and the second earpiece 3 are oriented toward a bilateral symmetry plane 17 about which the present invention is symmetric and which is defined later and shown in FIG. 4.

The headband chassis 1 may comprise any physical structure which serves to support the first earpiece 2 and the second earpiece 3 in the desired orientation and support the present invention in place on a dog's head. Additionally, the present invention may be custom designed to accommodate individual pets as well. For example, headphones designed for use by animals other than dogs may feature different sized speakers and headbands for accommodating the different sized heads of the animals. Alternative designs of the earpieces and headband chassis 1 include hooks or loops for wrapping around a dog's ears as well as designs that are oriented under and over the ears. The present invention may incorporate a single or multiple headbands, but the preferred embodiment of the present invention comprises an over the neck design. The headband chassis 1 may be curved to accommodate the unique contours of a dog's ears. Alternative designs of the headbands may include adjustable and foldable variants. The material of the headband chassis 1 is preferably lightweight, water resistant, and chew resistant. Additionally, any electronic components of the present invention are shock resistant for durability during drops and other instances of rough handling.

Figure 4:
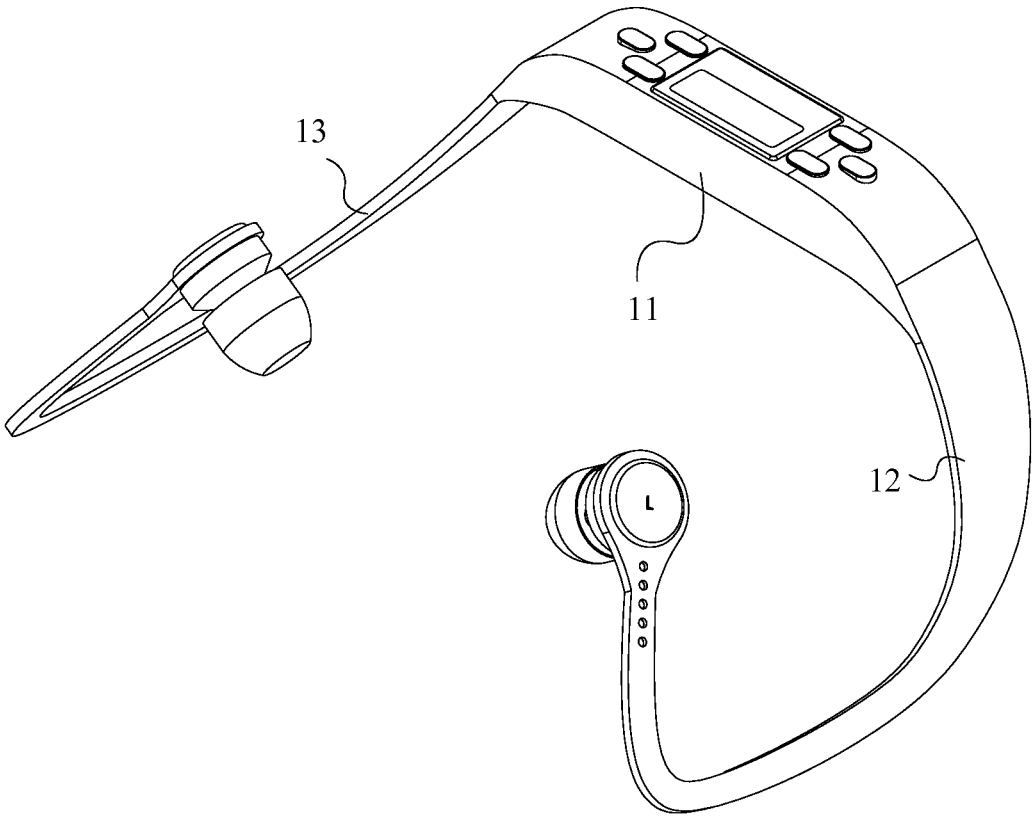
FIG. 4 is a perspective view of the present invention.
Figure 5:
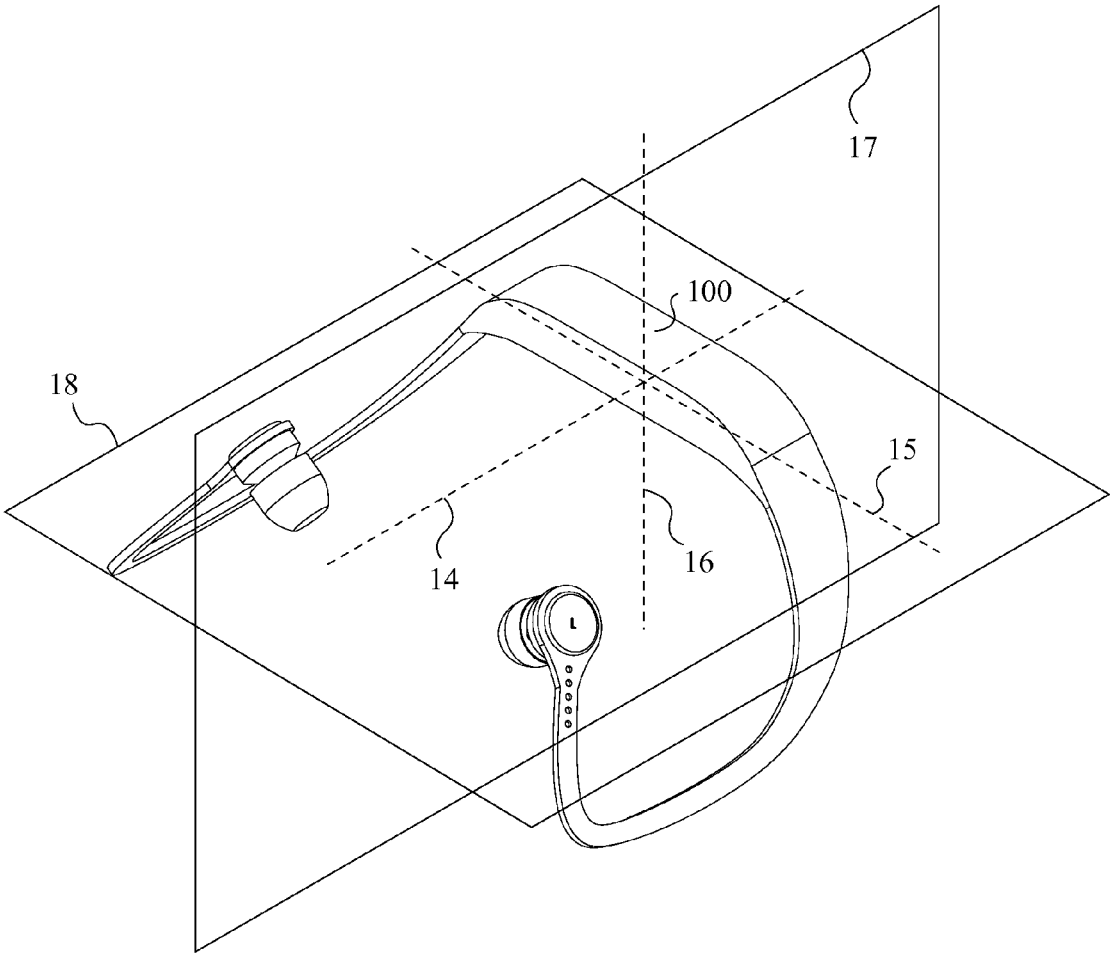
FIG. 5 is a perspective view of the present invention showing various reference axes and planes.

Referring to FIG. 4, in the preferred embodiment of the present invention, the headband chassis 1 comprises a central portion 11, a first lateral arm 12 and a second lateral arm 13. As shown in FIG. 5, a longitudinal axis 14, a lateral axis 15 and a vertical axis 16 are also defined for the headband chassis 1, and a bilateral symmetry plane 17 is defined by the longitudinal axis 14 and the vertical axis 16. The headband chassis 1 is symmetric about the bilateral symmetry plane 17. The first lateral arm 12 is connected to the central portion 11, and the second lateral arm 13 is connected to the central portion 11 opposite the first lateral arm 12 so that the headband chassis 1 has a form somewhat resembling a U shape. The first earpiece 2 is connected to the first lateral arm 12 opposite the central portion 11 and the second earpiece 3 is connected to the second lateral arm 13 opposite the central portion 11.

Figure 6:
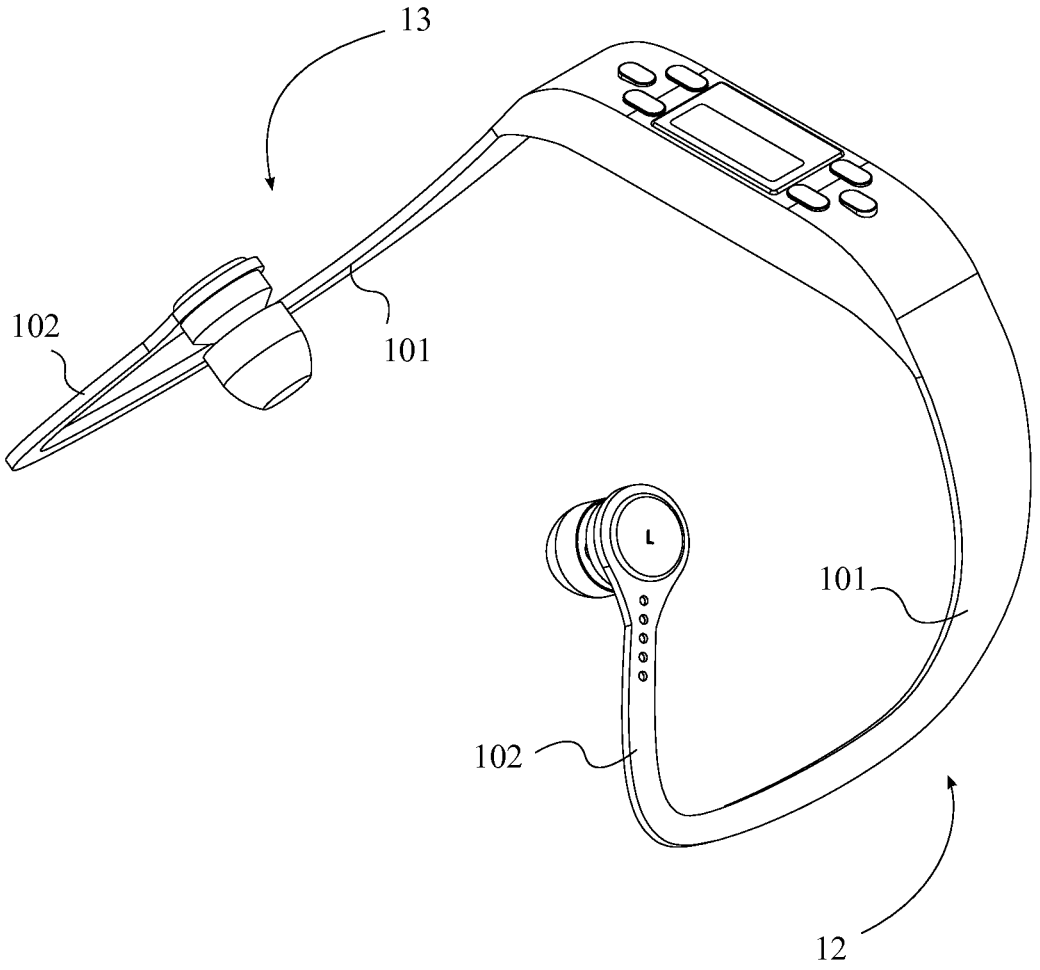
FIG. 6 is a perspective view of the present invention.

More particularly, as shown in FIG. 6 the first lateral arm 12 and the second lateral arm 13 each comprise a connector portion 101 and an angled portion 102. The connector portion 101 is connected to the central portion 11, and the angled portion 102 is connected to the connector portion 101 opposite the central portion 11. The first earpiece 2 is connected to the angled portion 102 of the first lateral arm 12 and the second earpiece 3 is connected to the angled portion 102 of the second lateral arm 13. In the preferred embodiment of the present invention, the first lateral arm 12 and the second lateral arm 13 each resemble a U shape. The connector portion 101 extends laterally and vertically away from the central portion 11, making approximately a 90 degree curve to form an L shape. The angled portion 102 is connected to the connector portion 101 at approximately a 90 degree angle, completing the U shape of the lateral arm. The angled portion 102 and the earpiece of each lateral arm function as a hook, with each earpiece being inserted into one of the dog's ears, providing support for the rest of the headband chassis 1 with the central portion 11 of the headband chassis 1 resting on the dog's neck. It should be understood that the first earpiece 2 and the second earpiece 3 are located in a forward position along the longitudinal axis 14 relative to the central portion 11, wherein the central portion 11 is located rearward of the first earpiece 2 and the second earpiece 3.

An alternate description of the preferred embodiment of the headphone chassis is provided hereinafter. As shown in FIG. 5, a top face 100 of the central portion 11 is defined, wherein the vertical axis 16 is orthogonal to the top face 100 and a vector normal to the top face 100 is defined as an upward direction. The central portion 11 is substantially rectangular, with a longer lateral dimension than a longitudinal dimension. The connector portion 101 of the first lateral arm 12 and the connector portion 101 of the second lateral arm 13 extend laterally outward, or away from the bilateral symmetry plane 17, downward, and forward, forming a three-dimensional arc resembling an L shape or approximately a 90 degree angle. The angled portion 102 is connected to the connector portion 101 and continues the path of the first lateral arm 12 and the second lateral arm 13 upward and slightly rearward and inward.

Figure 7:
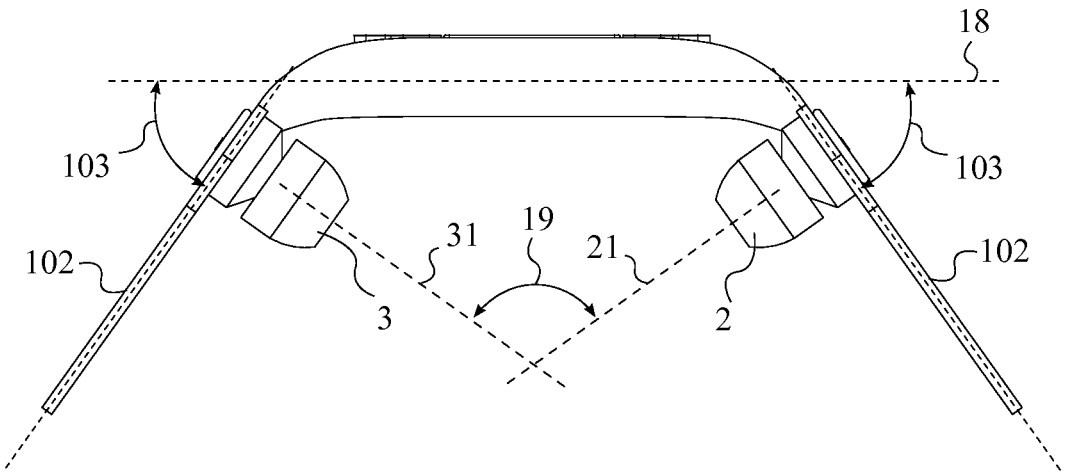
FIG. 7 is a front side view of the present invention.

As shown in FIG. 7, in the preferred embodiment the angled portion 102 is oriented at an acute angle 103 relative to a horizontal plane 18 defined by the longitudinal axis 14 and the lateral axis 15. Preferably, the acute angle 103 is within a range of 40 degrees to 60 degrees.

The first earpiece 2 and the second earpiece 3 are identical. In the preferred embodiment of the present invention, the first earpiece 2 and the second earpiece 3 resemble conventional in-ear headphones, also commonly known as earbuds. However, the first earpiece 2 and the second earpiece 3 are not necessarily limited to the aforementioned embodiment, and may comprise alternate embodiments, components or structures as appropriate and/or useful for the purpose of accommodating the ear anatomy of a dog or other domestic animal. In the preferred embodiment, the first earpiece 2 and the second earpiece 3 are substantially cylindrical as is common for in-ear headphone types. Therefore, the first earpiece axis 21 centrally traverses through the first earpiece 2 and the second earpiece axis 31 centrally traverses through the second earpiece 3. In the preferred embodiment, the first earpiece 2 is connected perpendicularly to the first angled portion 102 and the second earpiece 3 is connected perpendicularly to the second angled portion 102. This, the orientation of the first earpiece axis 21 and of the second earpiece axis 31 is defined by the orientation of the angled portion 102 of the first lateral arm 12 and the second lateral arm 13. The first earpiece axis 21 and the second earpiece axis 31 intersect each other at a specified angle 19, wherein the first earpiece axis 21 and the second earpiece axis 31 are oriented to match the angle of the vertical canal of a dog's ear. The specified angle 19 should be within the range of approximately 40 degrees to 120 degrees, or as required to match the angle of the vertical canal of a dog's ear.

In the preferred embodiment of the present invention, the audio produced by the present invention is configured to within a range of optimal comfort for animal use, specifically dogs. More particularly, the audio produced by the present invention is preferably limited to a frequency range of 200 hertz, to 15000 hertz, and a maximum volume of 75 decibels. However, alternate embodiments may comprise alternate frequency ranges and alternate volume limits. For example, one embodiment of the present invention may be intended for dogs that are hard of hearing. Therefore, the maximum volume in this alternate embodiment may be, but is not limited to, 95 decibels. In the preferred embodiment of the present invention, these limits are specified and maintained by coding present in the programming on board the chipset 4. In an alternate embodiment, the first earpiece 2 and the second earpiece 3 are manufactured with specific hardware or design that physically imposes the aforementioned limits on the first earpiece 2 and the second earpiece 3.

The chipset 4 and the power source 5 of the present invention provide the capability for an integrated music player. The chipset 4 is a component or combination of components of the electronic variety such as, but not limited to, circuit boards, wires, and processors necessary to facilitate the translation of electrical input signals into desired effects in the operation of the system. The chipset 4 receives electrical inputs from various sources, such as, but not limited to, a user interface, various sensors as appropriate, or a wired or wireless connection to a control device such as a smartphone or remote control, processes the inputs, and produces appropriate outputs, such as, but not limited to, signals to control music playback, or signals to control various other electronic components as appropriate, several of which are described later.

Figure 8:
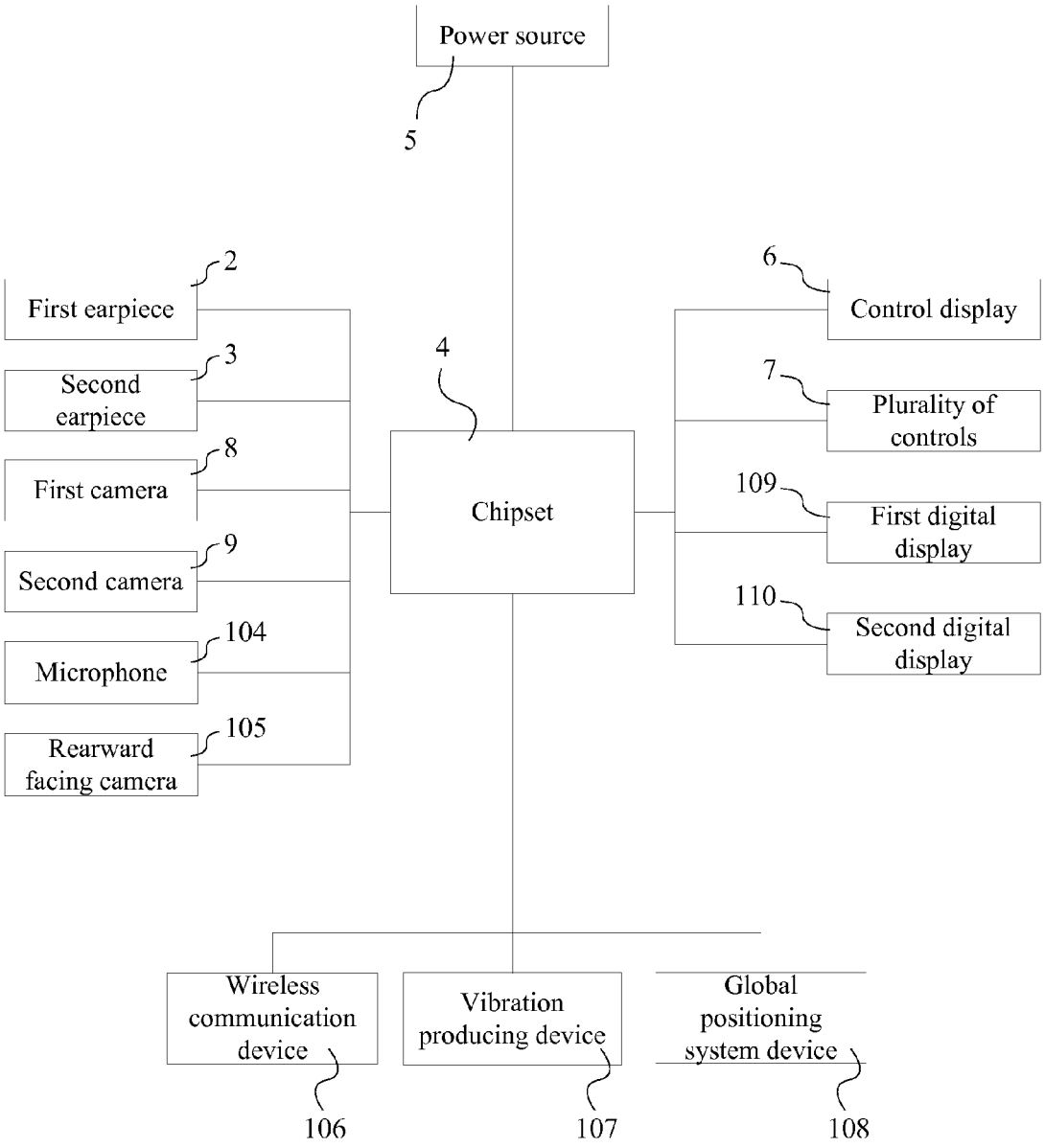
FIG. 8 is a schematic diagram of the electronic connections of the chipset.
Figure 9:
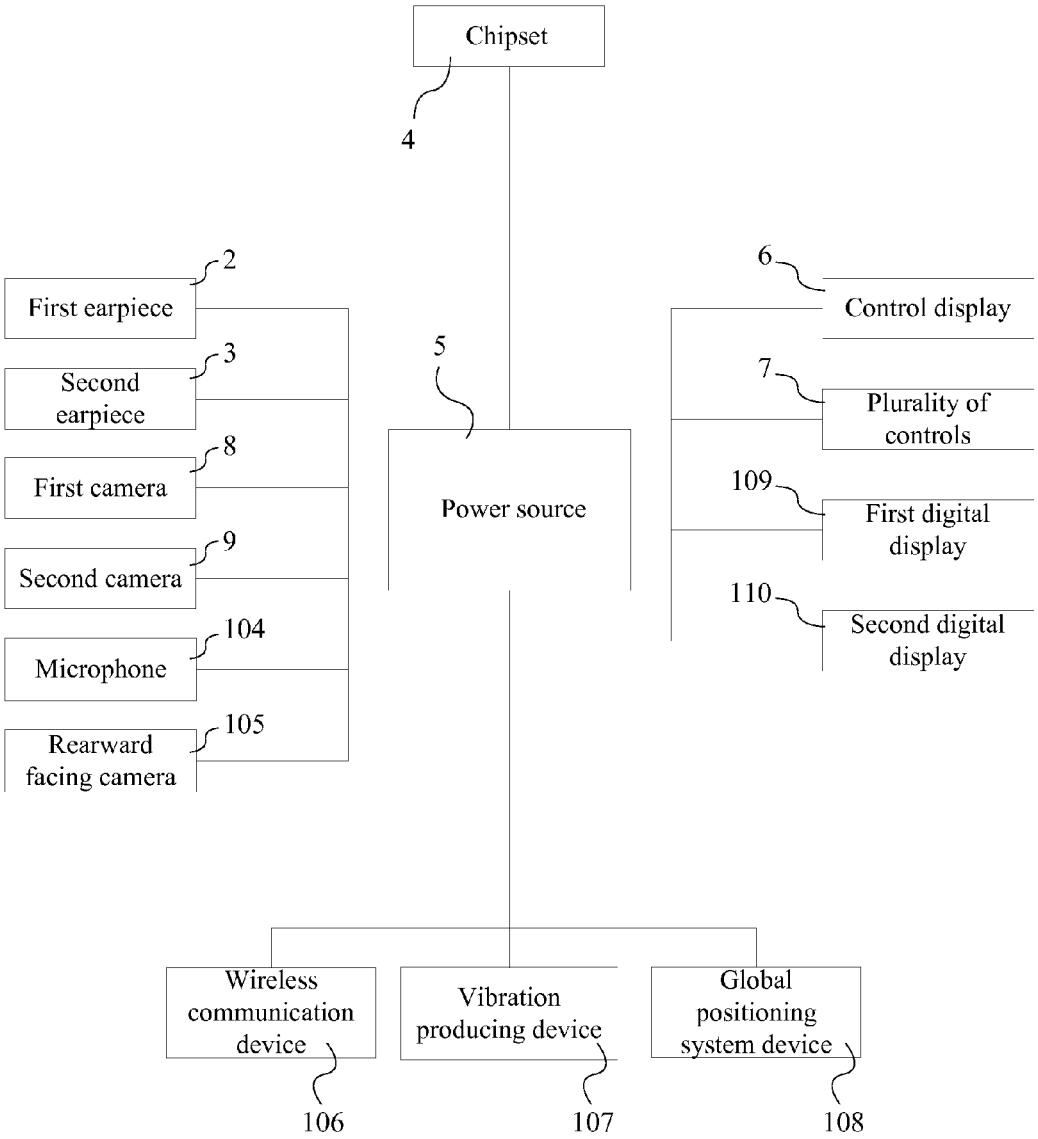
FIG. 9 is a schematic diagram of the electrical connections of the power source.
Figure 13:
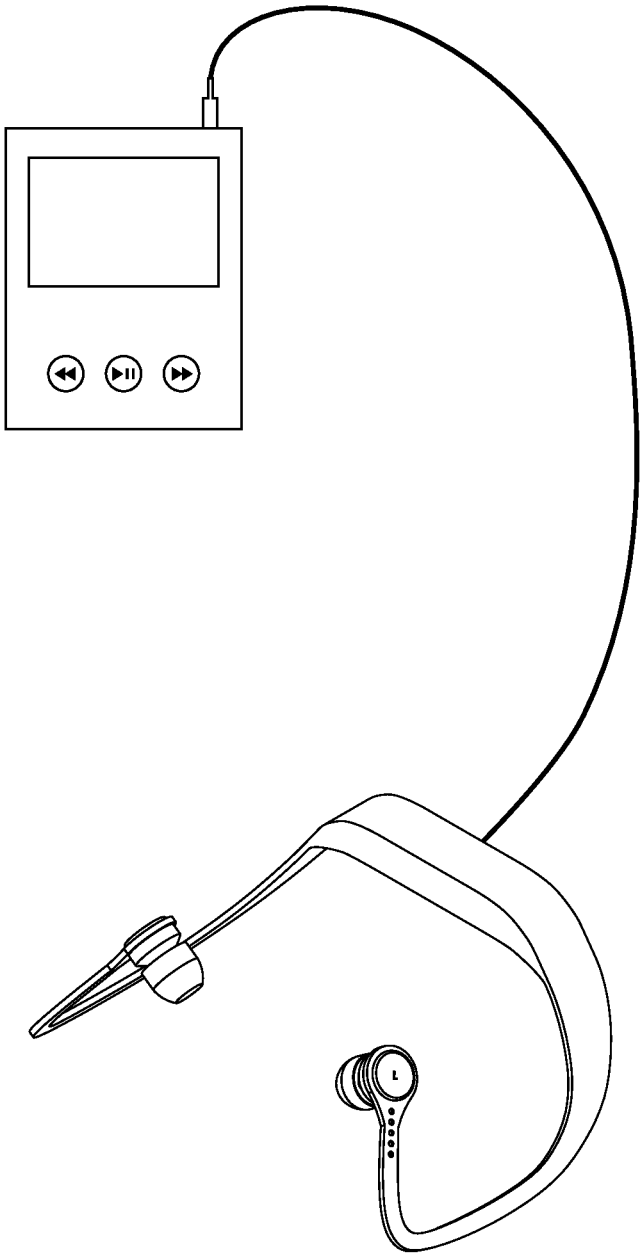
FIG. 13 is an illustration of the present invention with no display or controls and a wired connection to a separate audio player.

The power source 5 may be an integrated or replaceable rechargeable battery or batteries, or replaceable standard size disposable batteries. The power source 5 is electrically connected to the chipset 4. Users may upload or record their own audio files to the integrated music player. The integrated music player includes features found in conventional electronic devices such as the ability to recharge the battery as well as expandable memory capability, built in memory, or both. Additionally, the integrated music player may be controlled by means of a user remote control. The remote control may be used to turn the present invention and/or integrated music player on or off as well as to play specific prerecorded messages through the speakers, or utilize or control the various other electronic components. For example, a user may utilize the remote control to command a dog, for example, to stop moving, to come back, or to perform another action by playing a prerecorded message in his or her voice through the headphones. The remote control may be a user's electronic device such as a mobile phone or a standalone device. Schematic diagrams showing the electronic and electrical connections of the present invention are shown in FIGS. 8-9. It should be noted that while FIGS. 8-9 show a combination of all the electronic components described herein, various embodiments of the present invention may or may not comprise any of the electronic components, resulting in several possible embodiments comprising different combinations of features. One particular embodiment that should be noted is an embodiment that does not comprise the chipset 4, power source 5 or any other internal electronic components. This embodiment is similar to basic headphones with the exception of the inward and downward orientation of the first earpiece 2 and the second earpiece 3. In this basic embodiment, a wired connection to a separate audio player such as a CD player or MP3 player must be used, as illustrated in FIG. 13.

The preferred embodiment of the present invention further comprises a control display 6 and a plurality of controls 7 positioned atop the headband chassis 1, as shown in FIG. 2. The digital display and the plurality of controls 7 facilitate the functionality of the integrated music player. The digital display is electronically connected to the chipset 4 and electrically connected to the power source 5. The plurality of controls 7 is also electronically connected to the chipset 4. The digital display displays information such as, but not limited to, typical music player information such as track number, track title, and time elapsed. The plurality of controls 7 allow the user to perform functions such as, but not limited to, increase or decrease music playback volume, access a device menu, pause or continue playback of a track, fast forward or rewind a track, or skip forward or backward in a current playlist. Alternatively, the display 6 can be a liquid crystal display (LCD) touch screen, or a different kind of touch screen, eliminating the need for separate controls.

One function which may be incorporated by the present invention is a gradual volume decreasing function, wherein the volume outputted by the first earpiece 2 and the second earpiece 3 decreases by a certain amount at regular time intervals until the volume is zero, at which time the present invention automatically shuts off. This volume reduction function is intended to aid in dogs and other animals falling asleep.

The versatility of the present invention is increased by the incorporation of several additional features which are hereinafter described. Each of the following components may or may not be comprised in various embodiments of the present invention as desired.

Figure 10:
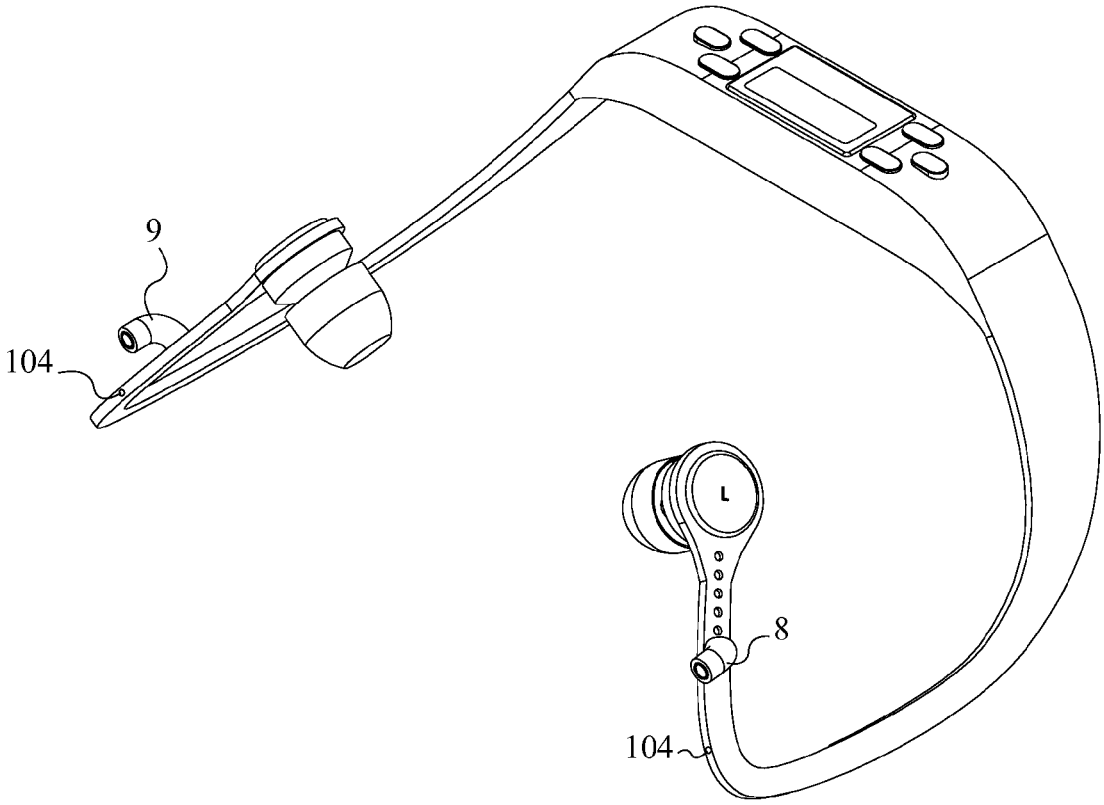
FIG. 10 is a perspective view of the present invention with a first camera, a second camera and two microphones.
Figure 11:
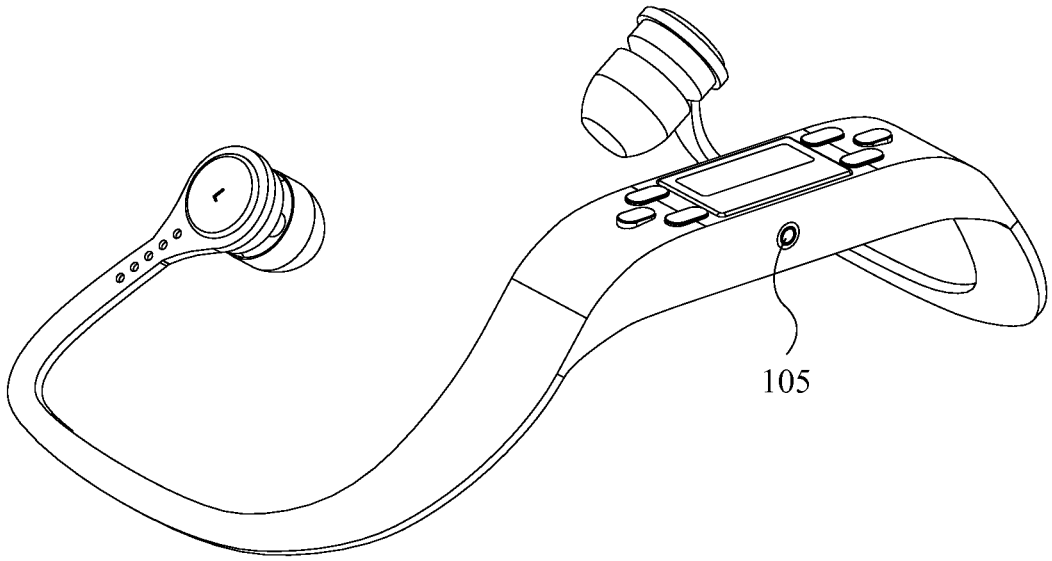
FIG. 11 is a rear perspective view of the present invention with a rearward facing camera.

As shown in FIG. 10, in one alternate embodiment of the present invention, a first camera 8 is positioned on the first lateral arm 12 adjacent to the first earpiece 2. Optionally, a second camera 9 is positioned on the second lateral arm 13 adjacent to the second earpiece 3. The first camera 8 and the second camera 9 are electronically connected to the chipset 4. Additionally, a microphone 104 may be comprised. The microphone 104 is positioned on the headband chassis 1 and electronically connected to the chipset 4. The first camera 8, the second camera 9 and the microphone 104 may simply collect images and sound or a streaming media feature may be comprised, where a user may monitor the immediate surroundings of his or her dog on their mobile phone. Connectivity may be achieved through technologies including, but not limited to, Wi-Fi, Bluetooth, and telecommunication networks.

In addition, a rearward facing camera 105 may be positioned on the headband chassis 1. The rearward facing camera 105 is electronically connected to the chipset 4 and oriented in a rearward direction, wherein the rearward direction is oriented parallel to the longitudinal axis 14 traversing from the first earpiece 2 and/or the second earpiece 3 toward the central portion 11 of the headband chassis 1. The rearward facing camera 105 enables further monitoring and/or video recording.

For many features of the present invention, a wireless communication device 106 is useful. The wireless communication device 106 is positioned in an appropriate location within the headband chassis 1 and electronically connected to the chipset 4. As previously mentioned, the wireless communication device 106 may utilize Wi-Fi, Bluetooth, telecommunication networks or other wireless communication technology in order to transfer data to and from the chipset 4 to other electronic devices.

The wireless communication device 106 may alternately or additionally function as a radio receiver so that the present invention provides the capability to listen to FM or AM radio stations broadcast over the air. Furthermore, the present invention may additionally comprise a speaker in addition to the first earpiece 2 and the second earpiece 3 so that audio may be listened to without actually inserting the first earpiece 2 and the second earpiece into the ears.

A vibration producing device 107 is another possible feature for the present invention. The vibration producing device 107 is electronically connected to the chipset 4 and electrically connected to the power source 5. The vibration producing device 107 is useful for pet control functions such as conventional invisible fence systems, and training functions provided by the user's mobile phone or other remote control. The vibration producing device 107 produces vibrations which are displeasing to the dog in order to provide negative stimuli for containing the pet within a defined area or for training purposes. Invisible fence and training capabilities may be further enhanced by emitting a displeasing audible sound through the first earpiece 2 and the second earpiece 3. Alternately, a prerecorded command in an owner's voice may be programmed to play to prevent the dog from crossing the boundary of an invisible fence. Additionally, the vibration producing device 107 and the displeasing audible sound may be used as an anti-barking deterrent or for other training purposes.

Another additional feature that may be integrated into the present invention is a global positioning system device 108 which is electronically connected to the chipset 4 and is electrically connected to the power source 5. In the event that a dog becomes lost, the global positioning system device 108 may be utilized by the user to quickly locate the dog.

Figure 12:
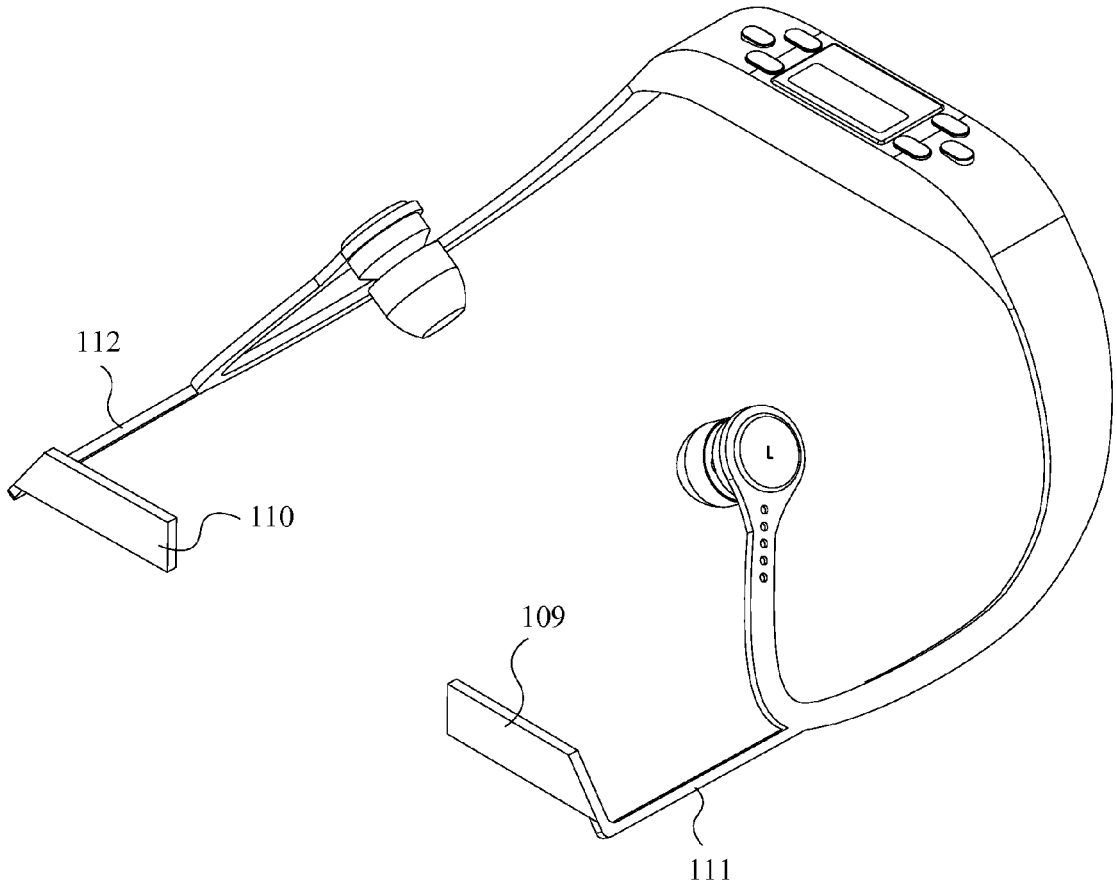
FIG. 12 is a perspective view of the present invention with two digital displays.

Referring to FIG. 12, a final additional feature that is contemplated for the present invention is a digital display which is positioned over the dog's eye, providing the dog with a heads-up display or other information which can be controlled via the user's mobile phone or remote control. One or two digital displays may be comprised. A first display arm 111 is connected to the headband chassis 1 adjacent to the connector portion 101 of the first lateral arm 12. The first digital display 109 is connected to the first display arm 111, and the first digital display 109 is electronically connected to the chipset 4. Similarly, if a second digital display 110 is comprised, a second display arm 112 is connected to the headband chassis 1 adjacent to the connector portion 101 of the second lateral arm 13. The second digital display 110 is connected to the second display arm 112, and the second digital display 110 is electronically connected to the chipset 4.

Although the invention has been explained in relation to its preferred embodiment, it is to be understood that many other possible modifications and variations can be made without departing from the spirit and scope of the invention as hereinafter claimed.

What is claimed is:

1. An animal headphone apparatus comprises:

a headband chassis;

a first earpiece with a first earpiece axis;

a second earpiece with a second earpiece axis;

a chipset, wherein the chipset provides music playback capability;

a power source;

the headband chassis comprises a central portion, a first lateral arm, a second lateral arm, a longitudinal axis, a lateral axis, and a vertical axis;

a bilateral symmetry plane being defined by the longitudinal axis and the vertical axis;

a rearward facing camera being positioned on the headband chassis;

a control display and a plurality of controls being positioned on the headband chassis;

the first lateral arm being connected to the central portion;

the second lateral arm being connected to the central portion opposite the first lateral arm;

the first lateral arm and the second lateral arm each comprise a connector portion and an angled portion;

the connector portion being connected to the central portion;

the angled portion being connected to the connector portion opposite the central portion;

the angled portion being oriented at an acute angle relative to a horizontal plane defined by the longitudinal axis and the lateral axis;

the acute angle being within a range of 40 degrees to 60 degrees;

the first earpiece being directly connected to the angled portion of the first lateral arm opposite the connector portion; and the second earpiece being directly connected to the angled portion of the second lateral arm opposite the connector portion;

the first earpiece and the second earpiece being oriented toward the bilateral symmetry plane; and the first earpiece axis and the second earpiece axis intersecting each other at a specified angle, wherein the first earpiece axis and the second earpiece axis are oriented to match the angle of the vertical canal of a dog's ear;

the first earpiece and the second earpiece being configured to produce audio within a range of optimal comfort for animal use;

the first earpiece and the second earpiece being configured to produce audio within a frequency range of 200 hertz to 15000 hertz; and the first earpiece and the second earpiece being configured to produce audio with a maximum volume of 75 decibels;

the rearward facing camera being electronically connected to the chipset; and the rearward facing camera being oriented in a rearward direction, wherein the rearward direction is oriented parallel to the longitudinal axis traversing from the first earpiece and the second earpiece toward the central portion of the headband chassis.

2. The animal headphone apparatus as claimed in claim 1 comprises: the headband chassis being symmetric about the bilateral symmetry axis.

3. The animal headphone apparatus as claimed in claim 1 comprises: the power source being electrically connected to the chipset.

4. The animal headphone apparatus as claimed in claim 1 comprises:

a first camera and a second camera;

the first camera being positioned on the first lateral arm adjacent to the first earpiece;

the second camera being positioned on the second lateral arm adjacent to the second earpiece; and the first camera and the second camera being electronically connected to the chipset.

5. The animal headphone apparatus as claimed in claim 1 comprises:

a microphone;

the microphone being positioned on the headband chassis; and the microphone being electronically connected to the chipset.

6. The animal headphone apparatus as claimed in claim 1 comprises:

a wireless communication device;

the wireless communication device being positioned within the headband chassis; and the microphone being electronically connected to the chipset.

7. The animal headphone apparatus as claimed in claim 1 comprises:

a vibration producing device;

the vibration producing device being electronically connected to the chipset; and the vibration producing device being electronically connected to the power source.

8. The animal headphone apparatus as claimed in claim 1 comprises:

a global positioning system device;

the global positioning system device being electronically connected to the chipset; and the global positioning system device being electrically connected to the power source.

9. The animal headphone apparatus as claimed in claim 1 comprises:

a first display arm being connected to the headband chassis adjacent to the connector portion of the first lateral arm;

a first digital display being connected to the first display arm; and the first digital display being electronically connected to the chipset.

10. The animal headphone apparatus as claimed in claim 9 comprises:

a second display arm being connected to the headband chassis adjacent to the connector portion of the second lateral arm;

a second digital display being connected to the second display arm;

the second digital display being electronically connected to the chipset.

11. The animal headphone apparatus as claimed in claim 1 comprises:

the control display and the plurality of controls being electronically connected to the chipset; and the control display being electrically connected to the power source.

* * * * *